US005955158A

United States Patent [19]

Wilkins

[11] Patent Number: 5,955,158

[45] Date of Patent: Sep. 21, 1999

[54] ARTIFICIAL FLOWER AND METHOD OF MAKING SAME

[76] Inventor: Gregory S. Wilkins, 1853 Woodrun Dr. S.E., Lowell, Mich. 49331

[21] Appl. No.: 08/763,672

[22] Filed: Dec. 11, 1996

[51] Int. Cl.[6] ..... A41G 1/00

[52] U.S. Cl. ..... 428/24; 156/61; 428/542.8

[58] Field of Search ..... 428/24, 542.8; 156/61

[56] References Cited

U.S. PATENT DOCUMENTS

| | | | |
|---|---|---|---|
| 719,632 | 2/1903 | Akeley | 428/17 |
| 894,449 | 7/1908 | Land | 156/61 X |
| 1,630,082 | 5/1927 | Graham | 428/24 X |
| 2,092,464 | 9/1937 | Matthews | 156/61 |
| 2,879,617 | 3/1959 | Popeil | 428/24 X |
| 4,685,949 | 8/1987 | Hacker | 428/24 X |

*Primary Examiner*—Henry F. Epstein

*Attorney, Agent, or Firm*—Price, Heneveld, Cooper, DeWitt & Litton

[57] ABSTRACT

An artificial flower is provided that comprises a plurality of petals and a core. The process for making the flower is also provided and includes the steps of flattening, tapering, and applying petals. The petals can be flattened by a specialized flattening machine comprised of a top paper roll, a bottom paper roll, a pair of thickness rollers and a rotating means. The petals can be tapered by a specialized tapering machine comprised of a pressure roller and a gum rubber belt.

17 Claims, 3 Drawing Sheets

ARTIFICIAL FLOWER AND METHOD OF MAKING SAME

BACKGROUND OF THE INVENTION

The present invention relates to artificial flowers. Many artificial flowers use an imitative cloth material as the petals. The petals, which are compressed and folded, are attached to a complicated wire knot at the end of a wire stem by the use of an adhesive to form a bud-like body. An outer layer of larger petals are then secured in a spaced relation. A rubber tube is placed over the wire to create a stem.

Other flower modeling kits use a stiffer material such as wood or tin as the petals where the petals were attached to the stem by a non-drying modeling material. The petals are dyed to achieve the colors desired.

Still other molded flowers are made of a silica composition, manufactured in a molding process to create a one-piece flower. This process uses a gum chicle as a binder to hold the material together.

Yet another process uses a mold with two dies to form the shape and texture of a leaf on a stem. However, none of these processes result in a realistic looking flower that is long-lasting and quick and easy to make. There is a desire for such a product and process.

SUMMARY OF THE INVENTION

This invention is a process for making an artificial flower, and the resulting flower, including the steps of cutting up pieces of modeling material into enough blanks to make up the petals of a flower, flattening the blanks, tapering the edges of the blanks, applying the blanks onto a core to form a flower, and hardening the flower.

These and other features, objects and advantages of the present invention will become apparent upon reading the following description thereof together with reference to the accompanying drawings.

DETAILED DESCRIPTION OF THE PREFERRED EMBODIMENTS

Figure 1:
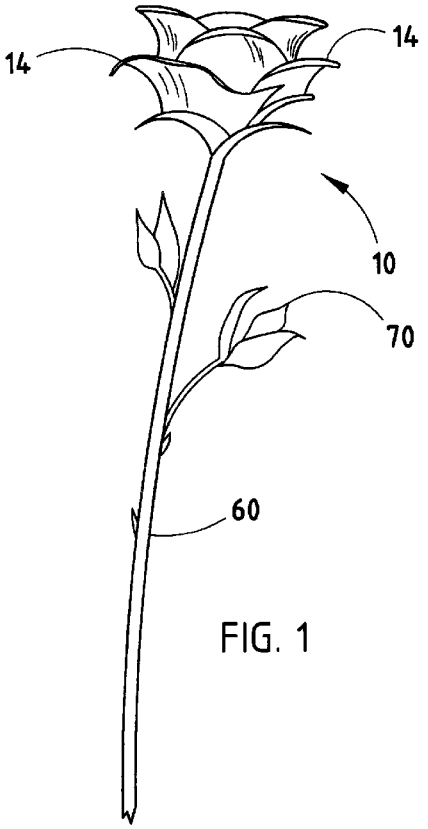
FIG. 1 is an elevational view of the artificial flower of the present invention.

The artificial flower 10 of the present invention is shown in FIG. 1. The artificial flower 10 of the invention generally includes a core 12, a plurality of petals 14, a stem 60 and leaves 70. (FIGS. 1 and 6) Core 12 is formed of a lightweight material that can handle the temperature required to harden the petals. Core 12 is preferably hollow to. keep the weight of the flower low and is preferably spherical or spheroidal, so the resulting flower will not be irregularly shaped. The core 12 is preferably a hollow glass bulb with an open base 44 to allow insertion of a stem.

Petals 14 are made of a moldable modeling material, preferably one that will not crack upon bending, flattening and tapering. Such modeling material is a modeling clay such as Promat™ brand clay mixed with a plasticizer diluent such as Super Elasticlay™. Further, the modeling material should be hardenable upon exposure to heat without becoming brittle. The modeling material must also be adhesive enough to be able to stay attached to the core. Petals 14 are shaped in different sizes, as described below, so as to simulate the petals of a rose.

The steps involved in the process of forming an artificial flower generally include cutting, flattening, and tapering the modeling material to form petal-shaped blanks, 16, 18 and 20. Once the blanks are formed, they are applied to a core 12 as petals 14 to form a flower 10. The flower 10 is then exposed to heat to harden. The modeling material used to form petals 14 may need to be mixed prior to the above-noted steps.

The preferred first step in the process of the present process invention of making an artificial flower of the present invention is mixing moldable material with plasticizer diluent to make a suitable modeling material to be used to form the petals of the artificial flower. A preferable moldable material should be durable while remaining slightly flexible after heating to a hard finish. An example of such a moldable material is Promat™ brand polymer clay. This is a strong polymer clay. A plasticizer diluent is preferably used to give the modeling material more of a flexible consistency and to eliminate cracking when the modeling material is bent or flattened. A good mixture is nine parts Promat™ polymer clay to one part plasticizer diluent. A typical plasticizer diluent used with modeling clay is Super Elasticlay™ brand flexible clay. This is a more rubbery, flexible clay, maintaining some "squeezability" after curing. The mixture is placed in and rolled through a commercially available roller mixer 15 to 20 times to make the mixture as homogeneous as possible and to force all of the air out of the mixture. Rolling the mixture through the mixer many more times than 20 will heat the mixture to a point where the mixture will start to cure. Therefore, mixing should be performed only until the modeling material becomes homogeneous and slightly warm.

Figure 2:
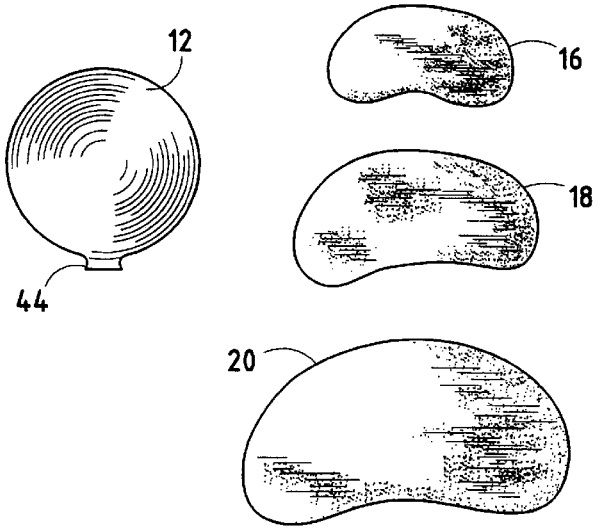
FIG. 2 is an elevational view of a core and a plan view of three different sized pieces of modeling material (blanks) which will become petals of the artificial flower of the present invention.

Once the modeling material is ready for use, it is cut into sized pieces or blanks, 16, 18 and 20, which are shown in FIG. 2 after they have been slightly flattened by hand. A standard rose uses preferably sixteen blanks which will become petals, each roughly a half-inch thick and a half-inch wide to start with. Preferably each petal, with the exception of five large petals, is a different size. This results in the most realistic-looking end product. However, as a practical matter, two or three different sizes of petals are used to save time cutting, if done by hand, or to save space and money since a die roller with sixteen different sized depressions would be very large and expensive. Where three sizes of petals are used, five small blanks 16 are cut to be approximately ¼ inch long, six medium blanks 18 are cut to be approximately ⅜ inch long, and five large blanks 20 are cut to be approximately one inch long. The blanks 16–20 are then flattened slightly by hand and hand-shaped to create the approximate shape of a flower petal. A flattening machine 22 is then used to further flatten the blanks so that the blanks will each be of a consistent thickness and all of the blanks will have the same thickness as the other blanks.

Figure 3:
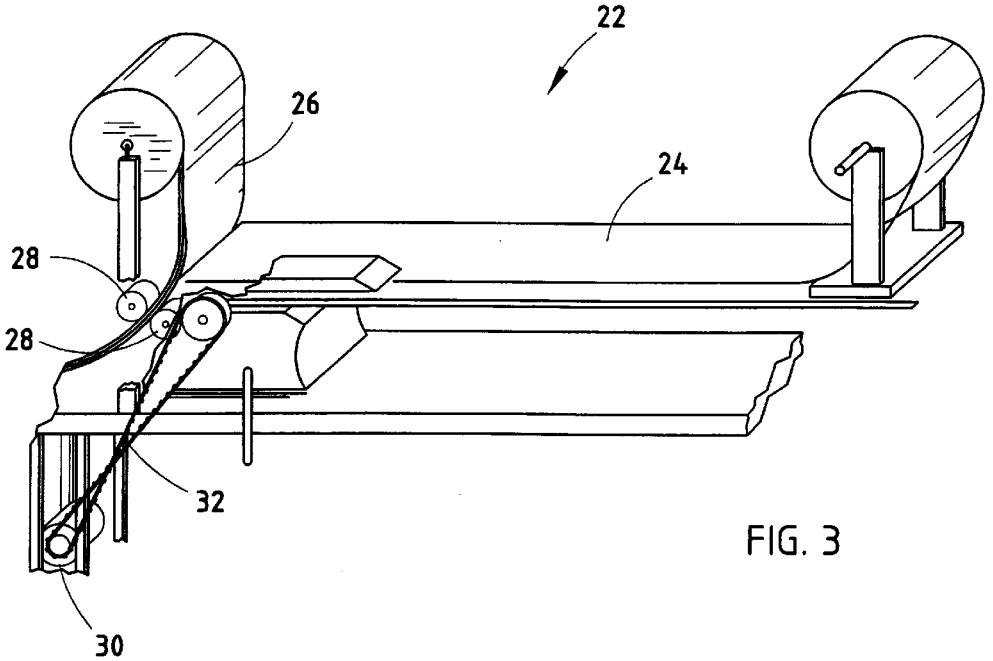
FIG. 3 is an elevational view of a flattening machine.

As seen in FIG. 3, the flattening machine 22 includes a bottom paper layer 24, a top paper layer 26, a pair of thickness rollers 28, a motor 30, and a belt 32. The paper used in the conveyor must be of a strength so it will not tear when pulled through the rollers, preferably a 20 to 25-pound hand towel paper. Also, the paper must be of such a quality as to not give off lint. The purposes of the paper are to provide a surface that the blanks are conveyed on, to provide texture to the blanks that adds to the appearance of the petals, to remove a slight amount of the oils from the blanks to further control their consistency, and to prevent tarnishment of and sticking to the various rollers, which are described below.

Shaped blanks 16–20 are placed on bottom paper layer 24, the bottom paper layer 24 being conveyed along a flat surface by an electric motor 30. Motor 30 rotates a belt 32 which in turn rotates the gears that rotate the pair of thickness rollers 28. One roller is rotated clockwise, while the other is rotated counterclockwise, thereby creating a pulling effect when the paper comes in contact with the thickness rollers 28. As the paper with the shaped blanks on it is pulled along the conveyor, the top paper layer 26 is placed over the blanks, thereby sandwiching the blanks between the two layers of paper. The shaped blanks 16–20 are conveyed between thickness rollers 28 to flatten out the blanks to the desired thickness. The pair of thickness rollers 28 can be from a typical pasta maker found in many food shops.

Figure 4:
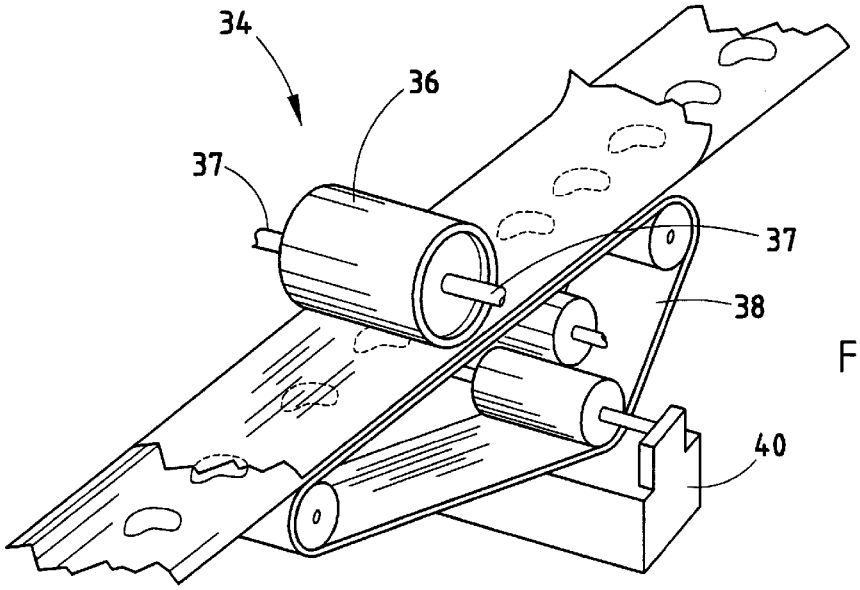
FIG. 4 is a fragmentary perspective view of a tapering machine with the safety cover off.

The edges of the blanks are then tapered by a tapering machine 34, the blanks 16–20 still sandwiched between the top and bottom hand paper towels. The tapering machine 34 generally includes a pressure roller 36, a belt 38, and an electric motor 40. (FIG. 4) Pressure roller 36 is on a rotatable axle 37 and is positioned so pressure roller 36 is in communication with belt 38, which is preferably made of 100% gum rubber. Belt 38 should be compressible enough to provide some give when a blank is conveyed between pressure roller 36 and belt 38, but should be firm enough to provide pressure around the outside edges of a clay blank, so as to provide a tapering effect. To give the right tapering and texture to the blanks, the gum rubber belt 38 is preferably approximately ⅜ inch thick so the blanks will be tapered properly without being flattened more than is preferred. Other thicknesses of the belt may be used depending on the modeling material used and the effect desired. The electric motor 40 rotates the gum rubber belt 38, which in turn conveys the sandwiched clay blanks between gum rubber belt 38 and pressure roller 36.

Figure 5:
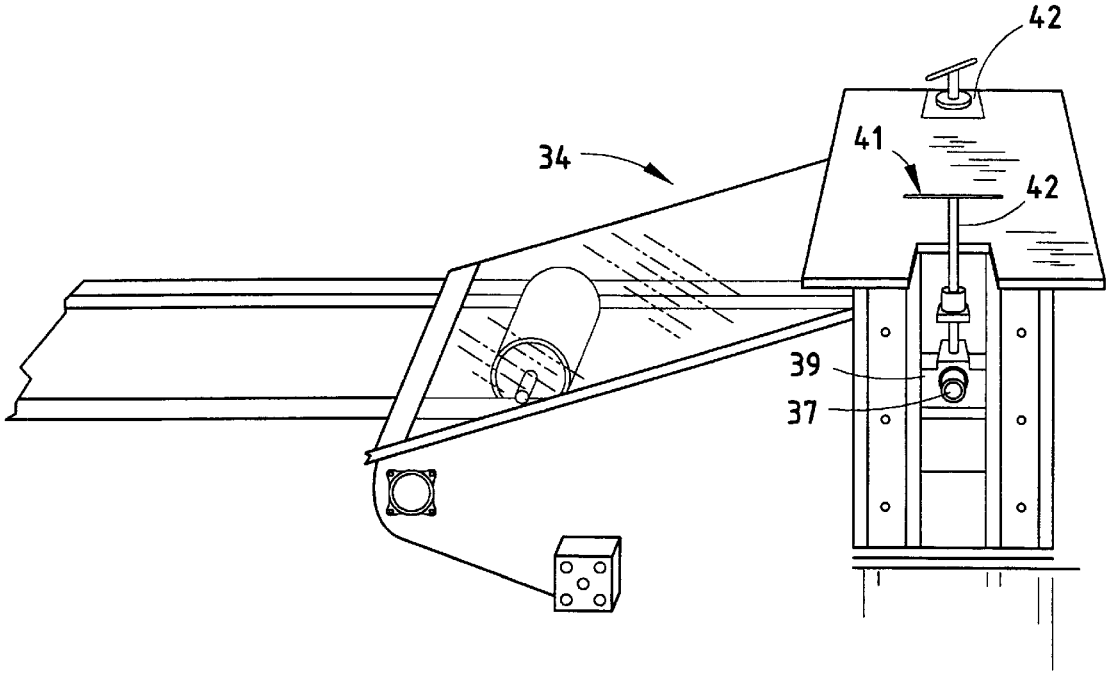
FIG. 5 is an elevational view of a tapering machine.

The pressure roller 36 should be at such a tension against the gum rubber belt so that the edges of the blanks are tapered, but so the blanks are not flattened significantly. This can be accomplished by the use of a tension guide 41 which is attached to axle 37 that pressure roller 36 rotates about. (FIG. 5) Axle 37 is mounted to bearing blocks 39. Threaded screws 42 bear down on bearing blocks 39 to adjust the height of axle 37. A handle on each threaded screw 42 is provided to allow the turning of the threaded screws 42. Tension guide 41 can be used to adjust the tension between the pressure roller 36 and the gum rubber belt 38. After tapering, the hand towel paper is pulled away from the blanks, which are now ready to be applied to the core as petals.

The blanks are applied by hand to the core. One of the small blanks 16 is first rolled up to create a scroll 43. (FIG. 6) Scroll 43 is placed on the top of core 12, which is preferably a 35 mm hollow glass bulb that has a short open bottom base 44. Such a glass bulb is typically used as a holiday decoration. The small blanks 16 are then applied by hand to core 12 around scroll 43, each blank overlapping the previous blank. The medium sized blanks 18 are then added around the core, again each blank overlapping the previous one. As the small and medium sized blanks are applied to the core, the modeling material on the lower half of the core is removed so that modeling material will not bunch up excessively on the lower half of the core and disfigure the resulting flower. Lastly, the large blanks 20 are added. The modeling material on the lower half of the core from the larger blanks should not be removed, but should be applied to cover the entire surface of the core. The large blanks 20 are pinched, teased and rolled back to give the appearance of the outer petals of a rose. The modeling material around the base 44 of the core is then cut off to expose base 44. The large blanks 20 may also be cupped before they are applied to the core to give a more natural look.

After all of the blanks 16–20 have been attached to the glass bulb core 12 and bent properly, the flower 10 should be hung upside down on a rack using a clip held by friction to the inside of the base of the glass bulb. The rack is then put in a conventional oven for 30 minutes at 275° to harden the flower. After removal from the oven, the flower 10 is set aside to cool. After cooling, the base 44 of the hollow glass bulb should be removed with a conventional grinder or sander. The rose is now complete, and is ready to be further adorned so as to be decorative.

Figure 7:
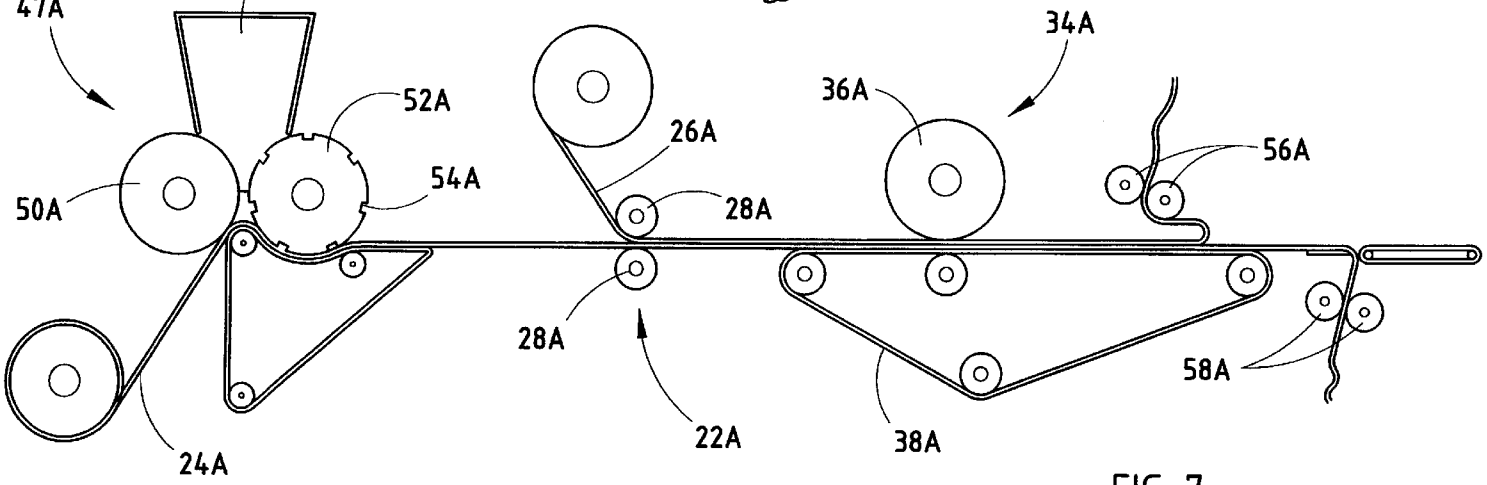
FIG. 7 is an elevational view of an automated artificial flower petal formation system.

An alternative and preferred process of the invention includes all of the steps of the previously described process, but with the shaping, flattening and tapering steps all performed by an automated system 46A. (FIG. 7) The modeling material is first formed into blanks by a sizer 47A. Sizer 47A includes a hopper 48A, a feed roller 50A and a die roller 52A. The modeling material is placed in hopper 48A which directs the modeling material between feed roller 50A and die roller 52A. The die roller 52A contains recesses 54A which size and shape the modeling material into different sized blanks. The blanks are dispensed onto a bottom hand towel paper layer 24A. A top layer of hand towel paper 26A is then placed over the blanks. The sandwiched blanks are then pulled through a flattener 22A, between a pair of opposing thickness rollers 28A which flatten the blanks. The thickness rollers are rotated by an electric motor (not shown) just as described above and shown in FIG. 3. The sandwiched blanks are then conveyed through a taperer 34A, between a pressure roller 36A and a gum rubber belt 38A, as described above, to taper the edges of the blanks. The top paper layer 26A is removed from the blanks by using a pair of top paper-pulling rollers 56A. The bottom paper layer 24A is then removed from the blanks by a pair of bottom paper-pulling rollers 58A, similar to the top paper-pulling rollers 56A. The blanks are then dispensed and are ready for application to the core as petals.

Figure 6:
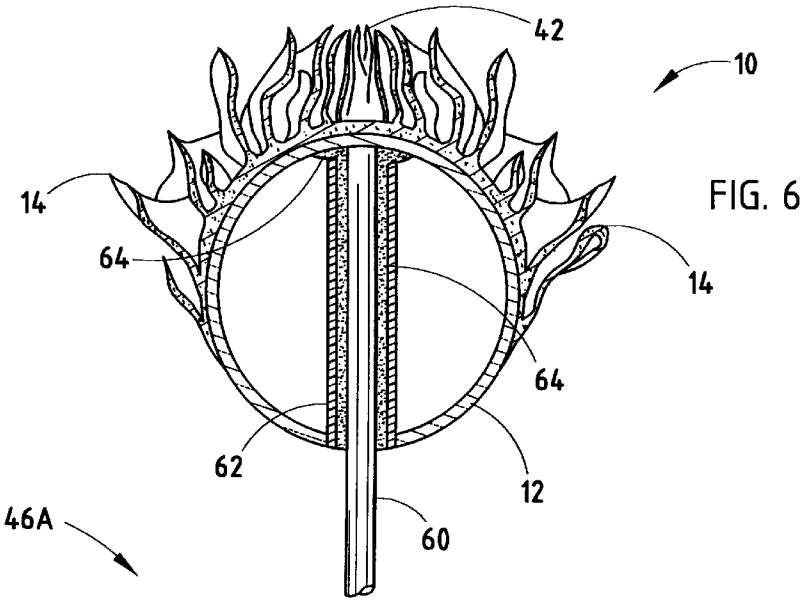
FIG. 6 is a cross-sectional view of the artificial flower of the present invention.

A stem 60 with attached leaves 70 may be attached to flower 10. As shown in FIG. 6, a piece of plastic tubing 62 with a diameter slightly smaller than that of the opening 64 in the bottom of the glass bulb is placed inside of the glass bulb to the top of the glass bulb. The tubing 62 is then cut off flush with the bottom of the glass bulb. Hot glue 64 is then placed inside the tubing 62 and the stem 60 is pushed to the top of the glass bulb, securing the stem to the top of the bulb and to the inside of tubing 62. A small amount of hot glue 64 should also then be put around the bottom of the glass bulb where the stem extends to secure the stem to the bottom of the rose. The rose then should be placed upside down to dry and cool further.

It will become apparent to those skilled in the art that various modifications to the preferred embodiment of the invention as described herein can be made without departing from the spirit or scope of the invention as defmed by the appended claims.

I claim:

1. A method of making an artificial flower, comprising the steps of:

(a) cutting modeling material into enough blanks to make up the petals of a flower, said blanks having edges, (b) flattening said blanks, (c) tapering said edges of said blanks, and (d) applying said blanks onto a core to form the shape of a flower.

2. The method of claim 1 wherein said modeling material comprises a modeling clay and a plasticizer diluent.

3. The method of claim 2 and further including the step of mixing the modeling clay and plasticizer diluent before the step of cutting the modeling material into blanks.

4. The method of claim 1 and further including the step of shaping the blanks before the step of flattening said blanks.

5. The method of claim 1 wherein said core is hollow.

6. The method of claim 5 wherein said core is spherical or spheroidal.

7. The method of claim 6 wherein said core is made of glass.

8. The method of claim 1 and further including the step of applying heat to the flower to harden it after the step of applying said blanks onto a core.

9. The method of claim 8 and further including the step of attaching a stem to the flower after the step of hardening said flower.

10. The method of claim 9 wherein the step of attaching the stem includes using plastic tubing and glue, said plastic tubing placed inside said core, said glue placed inside said plastic tubing, and said stem placed inside of said plastic tubing whereby said glue holds said stem in said plastic tubing and holds said plastic tubing in said core.

11. The method of claim 1 wherein the step of tapering said edges includes using a compressible belt and a pressure roller in communication with each other to create tension, said blanks being passed between said compressible belt and said pressure roller to taper said edges.

12. The method of claim 11 wherein said belt is made of gum rubber.

13. The method of claim 12 wherein said blanks are between layers of paper when passed between said compressible belt and said pressure roller.

14. The method of claim 13, wherein the tension exerted on said blanks by said pressure roller is adjustable.

15. The method of claim 1 wherein the step of flattening said blanks includes passing said blanks between a pair of opposed thickness rollers, and positioning said thickness close enough to each other to effectively pull said modeling material therethrough.

16. The method of claim 15 wherein the step of tapering said edges includes passing said blanks between a compressible belt and a pressure roller.

17. The product from the method of claim 1.

* * * * *

UNITED STATES PATENT AND TRADEMARK OFFICE

CERTIFICATE OF CORRECTION

PATENT NO. : 5,955,158

DATED : September 21, 1999

INVENTOR(S) : Gregory S. Wilkins

It is certified that error appears in the above-identified patent and that said Letters Patent is hereby corrected as shown below:

Col. 1, line 65
replace "to."
with --to--.

Col. 6, line 22
replace "thickness" (second occurance)
with --thickness rollers--.

Signed and Sealed this

Ninth Day of May, 2000

*Attest:*

Q. TODD DICKINSON

*Attesting Officer*

*Director of Patents and Trademarks*